US008444255B2

(12) United States Patent
Bakker et al.

(10) Patent No.: US 8,444,255 B2
(45) Date of Patent: May 21, 2013

(54) POWER DISTRIBUTION IN A THERMAL INK JET PRINTHEAD

(75) Inventors: Chris Bakker, Corvallis, OR (US); Lawrence H. White, Corvallis, OR (US); Bjorn Warloe, Portland, OR (US); Reynaldo V. Villavelez, Corvallis, OR (US); Paul I. Mikulan, Carrollton, TX (US); Kenneth Stewart, Coppell, TX (US); Michael Allen Godwin, Corvallis, OR (US); Teck-Khim Neo, Singapore (SG); Joseph M. Torgerson, Philomath, OR (US); Lonnie Byers, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 74 days.

(21) Appl. No.: 13/110,615

(22) Filed: May 18, 2011

(65) Prior Publication Data

US 2012/0293587 A1 Nov. 22, 2012

(51) Int. Cl.
*B41J 2/05* (2006.01)

(52) U.S. Cl.
USPC ..... 347/63; 347/62

(58) Field of Classification Search
USPC ..... 347/20, 44, 47, 56–59, 61–67
See application file for complete search history.

(56) References Cited

U.S. PATENT DOCUMENTS

| | | | | |
|---|---|---|---|---|
| 5,635,968 | A * | 6/1997 | Bhaskar et al. | 347/59 |
| 5,736,419 | A | 4/1998 | Naem | |
| 6,479,350 | B1 | 11/2002 | Ling et al. | |
| 6,762,085 | B2 | 7/2004 | Zheng et al. | |
| 6,902,257 | B2 | 6/2005 | Huang et al. | |
| 7,134,187 | B2 | 11/2006 | Liu et al. | |
| 7,344,227 | B2 | 3/2008 | King et al. | |
| 7,380,914 | B2 * | 6/2008 | Lebron et al. | 347/56 |
| 7,798,616 | B2 | 9/2010 | Bruce et al. | |
| 7,810,911 | B2 | 10/2010 | Shim et al. | |
| 7,824,977 | B2 | 11/2010 | Hu et al. | |
| 2004/0180483 | A1 | 9/2004 | Park et al. | |
| 2008/0316268 | A1 | 12/2008 | Silverbrook | |

FOREIGN PATENT DOCUMENTS

WO WO9903681 1/1999

OTHER PUBLICATIONS

Sang-Jin Lee, et al., "A Novel Five-Photo-Mask Low-Temperature Polycrystalline-Silicon CMOS Structure", IEEE, 2009, IEDM09-183-IEDM09-186, pp. 8.2.1-8.2.4.

* cited by examiner

*Primary Examiner* — Juanita D Jackson

(57) ABSTRACT

A thermal inkjet printhead may include a substrate and a resistive layer. A thermal resistor may be formed in the resistive layer. A first metal layer may be between the substrate and a resistive layer having a thickness to form a power bus. A dielectric layer may be between the first metal layer and the resistive layer.

19 Claims, 7 Drawing Sheets

POWER DISTRIBUTION IN A THERMAL INK JET PRINTHEAD

BACKGROUND

An ink jet image can be formed using precise placement on a print medium of ink drops emitted by an ink drop generating device known as an ink jet printhead. Typically, an ink jet printhead is supported on a movable print carriage that traverses over the surface of the print medium and is controlled to eject drops of ink at appropriate times pursuant to command of a microcomputer or other controller. The timing of the application of the ink drops can correspond to a pattern of pixels of the image being printed.

One type of an ink jet printhead includes an array of precisely formed nozzles in an orifice plate. The orifice plate can be attached to an ink barrier layer which can be attached to a film substructure that implements ink firing heater resistors and circuitry for enabling the resistors. The ink barrier layer can define ink channels including ink chambers disposed over the associated ink firing resistors, and the nozzles in the orifice plate can be aligned with associated ink chambers.

DETAILED DESCRIPTION

Figure 1:
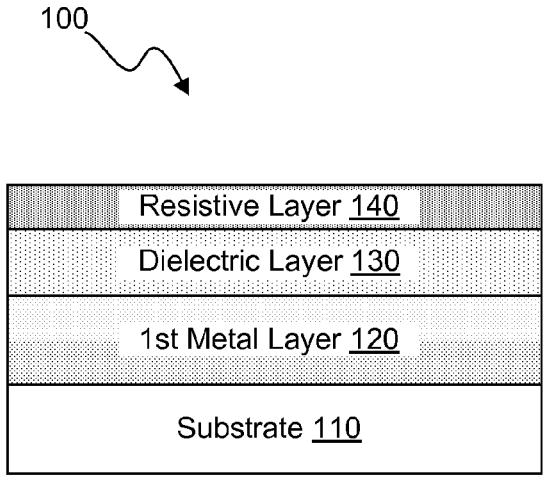
FIG. 1 is an illustrative diagram showing an ink jet printhead substrate with a metal layer between the substrate and a resistive layer in accordance with an example.

Alterations and further modifications of the illustrated features, and additional applications of the principles of the examples, which would occur to one skilled in the relevant art and having possession of this disclosure, are to be considered within the scope of the disclosure. The same reference numerals in different drawings represent the same element.

The cost of producing an ink jet printhead can be reduced by increasing the yield of the dies used in the ink jet printhead, fabricating more dies on a wafer, and/or eliminating layers and materials used in the fabrication process. An ink jet printhead can be fabricated using a complementary metal-oxide-semiconductor (CMOS) process, which can be referred to as a jet metal-oxide-semiconductor (JetMOS) process when used to create an ink jet printhead die. The integrated circuits (ICs) or dies used in the ink jet printhead can be fabricated using various layers and materials to make electrical circuit components and provide specific functions for the printhead. Layers can include metal layers for capacitors and connecting circuits, dielectric or insulation layers for capacitors and transistors and electrical insulation between conducting layers, diffusion layers for forming transistors, protection or passivation layers to protect the circuit from the environment, and/or a resistive layer for heat generation.

A bond pad layer can be an upper conductive layer used to fabricate an ink jet printhead. The bond pad layer can provide both bonds pads for the printhead and a power bus for the thermal resistors. Bond pads on the printhead dies can be used to provide electrical contacts or connections to the circuits on the die and to the leads on the chip packaging. Gold (Au) is often used in the bond pad layer because gold can be both electrically conductive and can resist oxidation and corrosion associated with the printhead die environment. Inks may include electrically conductive materials. The bond pad layer and other metal layers may not be exposed to inks because a voltage bias on metals can create electroplating of inks on and/or between metal contacts and traces, which can create shorts in the printhead circuit. Polymer, passivation, and dielectric layers can be used to protect metal layers from inks and other fluids.

Eliminating or reducing the gold and/or an upper bond pad layer can provide a cost saving in processing while still providing a similar reliability and functionality of a thermal inkjet printhead. When the gold and/or an upper bond pad layer is eliminated, the passivation layer can provide a better barrier and protection of lower metal layers from inks and other fluids, thus more aggressive inks can be used. Aggressive inks can be more corrosive to the layers of the printhead die. Aggressive inks may provide a greater variety of inks that can be used in graphics applications with the printhead. Moreover, the additional upper bond pad layer can increase the profile or angle of the thermal resistor trenches created by the layers above a resistive layer. So, reducing or eliminating the upper bond pad layer can reduce the profile or angle of the thermal resistor trenches, which can improve the reliability of the circuit by increasing the adhesion of a passivation layer to the resistive layer and other layers above the resistive layer.

When a metal layer covers a large portion of the die surface area or foot print of the die and/or has a relatively thicker depth compared to other metal layers, the metal layer can be referred to as a power plane, power bus, ground plane, or ground bus. The power bus can be used to route the current and power to and from the various components and circuits on the die, including the thermal resistors used in ink jet printing.

Metal layers in integrated circuit (IC) processing can be formed after diffusion and other high temperature processes, so the thermal processes do not melt the metal, diffuse the metal into other layers, or degrade the performance of the metal or traces. Thus, the metal layers or electrically conductive layers can be found in the upper layers of an IC or performed in the later processing steps. Metal or conductive layers can have a low resistance value allowing current to flow with minimal heat generation, which can be measured by sheet resistance ($R_S$). Sheet resistance can be calculated based on the thickness of the layer and the resistivity (ρ) of the material. Conductive layers can have a high thermal conductivity (κ).

Thermal resistors can be fabricated in a resistive layer formed from a resistive material. The resistive material can have a high resistivity relative to a conductor and a lower resistivity relative to an insulator. The thermal resistors can generate heat for an ink chamber when current flows through the resistor. A power bus or traces in a power plane can be used to provide current to the thermal resistors. A ground bus or traces in a ground plane can be used to take current away from the thermal resistors. Throughout this description power bus and ground bus may be used interchangeably, where both the power bus and ground bus are used to handle the current for the circuit components. A power bus can refer to a structure used to provide current to a circuit component and a ground bus can refer to a structure used to take current away from a circuit component or providing a mechanism to drain or eliminate excess electrical energy from circuits.

Many ink jet printhead dies can use a bond pad layer to connect wire leads from the chip package to the die. Because ink jet printhead dies can be in physical contact with inks and other fluids that can oxidize and corrode the layers of the printhead die, layers that can resist oxidation and corrosion are typically used to protect the die and layers under the protective layers. Silicon nitride (SiN) and silicon carbide (SiC) can be used a passivation layer to protect the underlying layers.

Bond pads on the die can be used to provide electrical contacts or connections to the circuits on the die and to the leads on the chip packaging. Chip leads can be connected to bond pads with wire fibers. The bond pads can be formed from a conductive bond pad layer. Metal materials can be used in the bond pad layer. Gold (Au) is often used in the bond pad layer because gold can be both electrically conductive and can resist oxidation and corrosion associated with the printhead die environment. Each layer formed on a substrate can be used to form circuit components and/or provide various functions in different sections of the die. Often layers can be used to provide a variety of functions and different types of circuits. Each layer increases the cost to produce a die, so reducing the number of layers while still providing the same functionality can reduce the cost of fabricating dies and wafers.

The bond pad layer can be used for both bond pads and a power bus. A conductive layer, often a metal layer, used to form a power bus may have a greater current capacity than other metal layers. A metal layer's current capacity can be determined by the conductive material's resistivity (ρ), the metal layer thickness, and the area of the traces used in the power bus. A power bus metal layer can be thicker than other metal layers. For example, if a standard non-power-bus metal layer has a depth or overall thickness of 0.8 μm with a metal or metal alloy, a power bus metal layer can have a depth of 1.2 μm with the same metal or metal alloy. Since a bond pad layer is often fabricated with gold, which can be used for both bond pad contacts and a power bus, the bond pad layer can be thick using a relatively substantial quantity of gold. Gold can be more expensive than other conductive materials such as aluminum (Al), copper (Cu), and tungsten (W) used in semiconductor processing. Not only can a metal layer including gold be expensive layer to fabricate, but other layers, such as tantalum (Ta) and titanium (Ti), may be used on either side of the gold metal layer to adhere the gold to other semiconductor processing layers.

The power bus for an ink jet printhead 100 can be a first metal layer 120 between the substrate 110 and a resistive layer 140, as illustrated in FIG. 1. The first metal layer can have a thickness to form a power bus. The substrate may include silicon (Si), gallium arsenide (GaAs), or other elements and compounds used in semiconductor wafers and dies. A thermal resistor can be formed in the resistive layer. A dielectric layer 130 can provide electrical insulation and thermal insulation between the resistive layer and the first metal layer. The resistive layer, dielectric layer, and first metal layer can be below the bond pad layer, where "below" can refer to a layer closer to the substrate than another layer and "above" can refer to a layer farther from the substrate than another layer. Reference to a thickness of a layer can refer to overall thickness, average thickness, or targeted thickness, where a targeted thickness can be a process used to achieve a specified thickness of a material in a layer.

Figure 2:
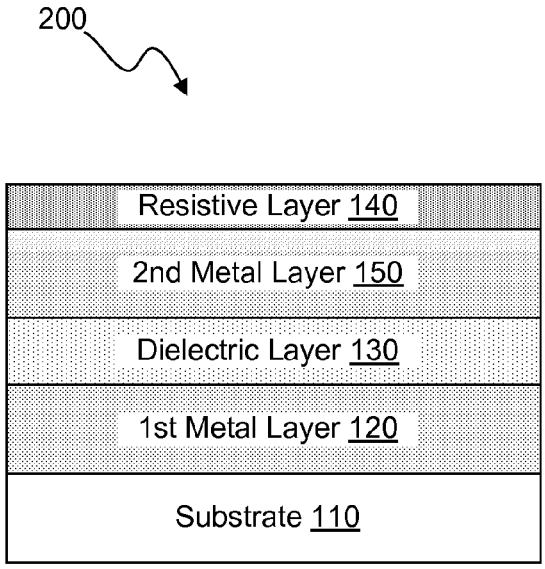
FIG. 2 is an illustrative diagram showing an ink jet printhead substrate with a first metal layer between the substrate and a resistive layer, and a second metal layer below the resistive layer in accordance with an example.
Figure 3:
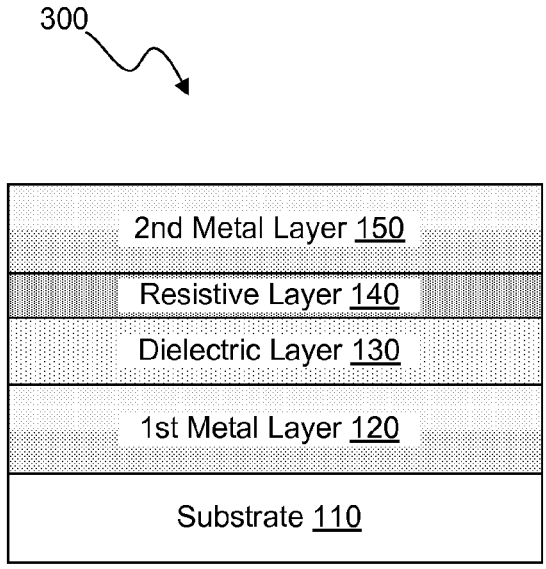
FIG. 3 is an illustrative diagram showing an ink jet printhead substrate with a first metal layer between the substrate and a resistive layer, and second metal layer above the resistive layer in accordance with an example.

In another example illustrated in FIG. 2, a second metal layer 150 may be used as a power and/or ground bus and a first metal layer 120 may be used as a power and/or ground bus. The second metal layer can be adjacent to or in contact with the resistive layer 140 and provide current to the thermal resistors. The second metal layer can be below the resistive layer in a printhead 200, as illustrated in FIG. 2, or the second metal layer can be above the resistive layer in a printhead 300, as illustrated in FIG. 3. The first metal layer and/or second metal layer can be used to couple or connect the thermal resistor to a control circuit or other electronic circuits on the thermal inkjet printhead. The dielectric layer can be between the first metal layer and second metal layer.

In an example, the power bus for an ink jet printhead can be moved from the bond pad layer to a first metal layer and/or a second metal layer. Moving the power bus to the first metal layer and/or the second metal layer can reduce a thickness of an upper bond pad layer and/or the amount of gold used in fabricating the bond pad layer. In another example, moving the power bus to the first metal layer and/or the second metal layer can eliminate the bond pad layer and eliminate the gold used in a bond pad layer. When the bond pad layer fabricated with gold is eliminated, the bond pads can be formed in or on the first metal layer and/or a second metal layer.

Figure 4:
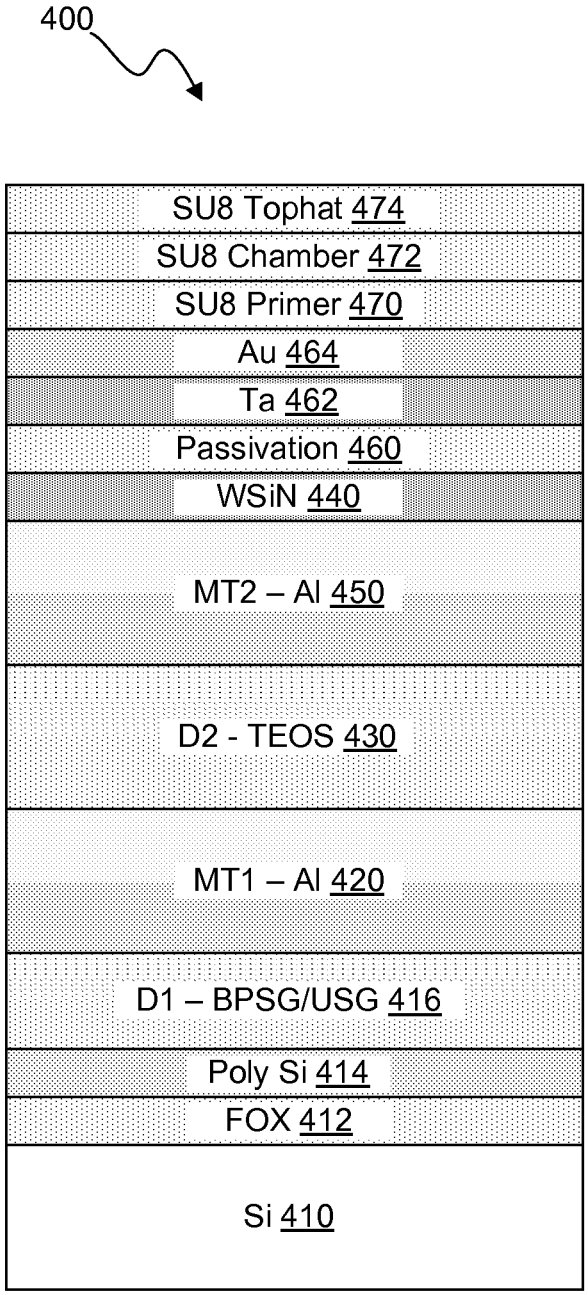
FIG. 4 is an illustrative diagram showing an ink jet printhead substrate with a metal layer between the substrate and a resistive layer along with other example layers in accordance with an example.

FIG. 4 illustrates an example of layers that can be used in a thermal ink jet printhead 400. A field oxide (FOX) 412 can be formed on a silicon (Si) 410 substrate. The field oxide can be a dielectric material. A dielectric material for the field oxide, dielectric layer, and other electrical and/or thermal insulating layers can include tetraethyl orthosilicate (TEOS or $Si(OC_2H_5)_4$), silicon dioxide ($SiO_2$), undoped silicate glass (USG), phospho-silicate glass (PSG), boro-silicate glass (BSG), and boro-phospho-silicate glass (BPSG), $Al_2O_3$, $HfO_3$, SiC, SiN, or combination of these materials.

The field oxide layer 412 can be grown from the silicon 410 or created from the oxidation of the silicon. The conductive layer or metal layer, the resistive layer, the dielectric layer, the passivation layer, a polymer layer, and other layers may be deposited using physical vapor deposition (PVD), chemical vapor deposition (CVD), electrochemical deposition (ECD), molecular beam epitaxy (MBE) or atomic layer deposition (ALD). Photolithography and masks may be used to pattern the dopants and the other layers. Photolithography may be used to protect or expose a pattern to etching which can remove material from the conductive or metal layer, the resistive layer, the dielectric layer, the passivation layer, the polymer layer, and other layers. Etching may include wet etching, dry etching, chemical-mechanical planarization (CMP), reactive-ion etching (RIE), deep reactive-ion etching (DRIE). Etching may be isotropic or anisotropic. The resulting features from deposition and etching of layers can be resistors, capacitors, sensors, ink chambers, fluid flow channels, contact pads, wires, and traces that can connect the devices and resistors together.

The silicon 410 may be doped or implanted with elements like boron (B), phosphorous (P), arsenic (As) to change the silicon's electrical properties and may be used to create regions or wells that can be used to create pn junctions used for diodes and transistors. The elements or dopants may be used to change the electrical properties affecting current flow and direction of current flow. The elements or dopants may be deposited on the surface of the wafer by an ion implantation process. The dopants may be selectively applied to the silicon using a mask or an implant mask and may create an implanted doped layer (not shown). The mask may be applied using photolithography. The dopants may be absorbed by the wafer and diffused through the silicon using a heat, thermal, annealing, or rapid thermal annealing (RTA) process.

A polysilicon layer 414 may be deposited on the surface of the wafer or silicon 410. The polysilicon layer can be a conductive layer.

A boro-phospho-silicate glass (BPSG) and/or an undoped silicate glass (USG) layer 416 can be deposited on the substrate. The BPSG/USG layer can be between 0.5 μm and 1.5 μm thick. The BPSG/USG layer can provide electrical insulation between the polysilicon layer 414 and a first metal layer 420.

The first metal layer 420 can be deposited on the substrate and can have a thickness to form a power or ground bus. A first metal layer and/or a second metal layer can include platinum (Pt), copper (Cu) with an inserted diffusion barrier, aluminum (Al), tungsten (W), titanium (Ti), molybdenum (Mo), palladium (Pd), tantalum (Ta), nickel (Ni), or combination. The metal layer may have a thermal conductivity (κ) greater than 20 W/(m·K) for temperature range between 25° C. and 127° C. For example, the first metal layer can include Aluminum (Al) with a 0.5% Copper (Cu). The first metal layer can be between 0.4 μm and 2.0 μm thick, and can have a sheet resistance of less than 45 mΩ/square. In one example, the first metal layer may cover at least 50% of an area or a footprint under the thermal resistors of the printhead. Alternatively, the first metal layer may cover at least 50% of an area or a footprint of the printhead circuit. A first metal layer with thickness to form a power bus or power/ground plane below the thermal resistors can reduce the parasitic resistance in series with thermal resistors.

A dielectric layer 430 can provide electrical insulation to prevent shorting between the thermal resistor in a resistive layer 440 and the first metal layer 420. The dielectric layer can provide thermal insulation to reduce heat dissipation from the thermal resistor to the thermally conductive first metal layer. The dielectric layer can reduce the effects of the first metal layer acting as a heat sink. The dielectric layer can be deposited on the substrate and can have a thickness, thermal conductivity (κ), and/or thermal diffusivity (α) so the turn on energy of the thermal resistors is not excessive and can provide a steady state heat accumulation and dissipation. Heat accumulation can be the heat used to eject the ink or fluid from the chamber. Heat dissipation can allow the ink or fluid into the chamber after ejection of a fluid bubble. A steady state heat accumulation and dissipation can minimize vapor lock. Thermal diffusivity (with SI unit of $m^2/s$) for a material can be a thermal conductivity divided by the volumetric heat capacity represented by $$\alpha = \frac{k}{\rho c_p},$$

where $\rho_{C_p}$ is the volumetric heat capacity with the SI unit of $J/(m^3 \cdot K)$, ρ is the density with the SI unit of $kg/m^3$, $c_p$ is the specific heat capacity with the SI unit of J/(kg·K), and κ is the thermal conductivity with the SI units of W/(m·K). The thermal conductivity of the dielectric layer can be between 0.05 W/cm° K and 0.2 W/cm° K. In an example, the thermal diffusivity of the dielectric layer can be between 0.004 $cm^2$/sec and 0.25 $cm^2$/sec.

When the dielectric layer is thin, excessive energy may be applied to create a drive bubble due to heat loss to the silicon substrate 410 which can be an inefficient use of energy. When the layer is thick, heat can be trapped and eventually cause vapor lock in the ink jet chamber so the printhead does not function properly. Balanced thickness of the dielectric layer can improve ink bubble creation, heating, and delivery (or ejection). In one example, the dielectric layer may have a thickness between 0.8 μm and 2 μm to provide thermal insulation between the first metal layer and the resistive layer under the thermal resistor. In another example, the dielectric layer can have a thickness between 0.4 μm and 2 μm to provide thermal insulation between the first metal layer and the resistive layer, generally.

A second metal layer 450 can be deposited on the substrate and can have a thickness to form a power and/or ground bus. For example, the second metal layer can include aluminum (Al) with copper (Cu), and the second metal layer can be between 1.0 μm and 2.0 μm thick. For example, the first metal layer and/or second metal layer can have a sheet resistance of less than 45 mΩ/square. The first metal layer and/or second metal layer can provide power and/or ground routing to and from bond pads formed in a bond pad layer. The second metal layer can contact the thermal resistors formed in the resistive layer 440 and provide a conductive path to the thermal resistors. In one example, the first metal layer and/or second metal layer may cover at least 50% of an area or a footprint under the bond pads of the printhead. In another example, the second metal layer may cover at least 50% of an area or a footprint of the printhead circuit.

A via can be formed in the dielectric layer between a first metal layer and a second metal layer (not shown) away from an ink feed hole (IFH) to reduce the possibility of ink ingress. The via formed between a first metal layer and a second metal layer can be at least 0.25 μm away from the thermal resistor and/or an ink feed hole. An ink feed hole can be a hole etched through the die in order to get ink from a pen to the flow channels and chamber which can be defined in a polymer layer 470, 472, and/or 474.

A resistive layer 440 can be deposited on the substrate. The resistive layer can include tungsten silicide nitride (WSiN), tantalum silicide nitride (TaSiN), tantalum aluminum (TaAl), tantalum nitride ($Ta_2N$), or combination. The resistive layer can be between 0.025 μm and 0.2 μm thick, and the resistive layer can have a sheet resistance between 20 Ω/square and 2000 Ω/square, for example. The thermal resistor used in a thermal ink jet printhead can be formed in the resistive layer.

A passivation layer 460 can be deposited on the substrate. The passivation layer can include silicon carbide (SiC), silicide nitride (SiN), or a combination of such materials. In one example, the passivation layer can be between 0.1 μm and 1 μm thick. The passivation layer can provide a protective coating and/or electrical insulation on the printhead, die, or wafer to protect the underlying circuits and layers from oxidation, corrosion, and other environmental conditions.

An adhesion layer 462 can be deposited on the substrate. Some elements and compounds, such as gold, used in fabrication may not adhere well to the substrate or other layers on the substrate. An adhesion layer can be used to adhere or join one layer to another. The adhesion layer can be used to join a bond pad layer to the passivation layer, a metal layer, a resistive layer, a dielectric layer, or the substrate. For instance, the adhesion layer can include tantalum (Ta).

A bond pad layer 464 can be deposited on the substrate. The bond pad layer can include gold (Au). 1 μm of gold can have a sheet resistance of approximately 28 mΩ/square. The bond pad layer can be between 0.1 μm and 0.5 μm thick with a sheet resistance between 56 mΩ/square and 280 mΩ/square. A first metal layer and/or the second metal layer having a thickness to form a power bus can decrease the thickness of the bond pad layer, and can increase the sheet resistance of the bond pad layer. The average sheet resistance of the bond pad metal layer may be a multiple of the value of average sheet resistance of the first metal layer and/or the second metal layer. For example, the average sheet resistance of the bond pad metal layer may be at least three times the value of average sheet resistance of the first metal layer and/or the second metal layer. Bond pads can be formed in the bond pad layer. Bond pads on the die can be used to provide electrical contacts or connections to the circuits on the die to the leads on the chip packaging.

Figure 5:
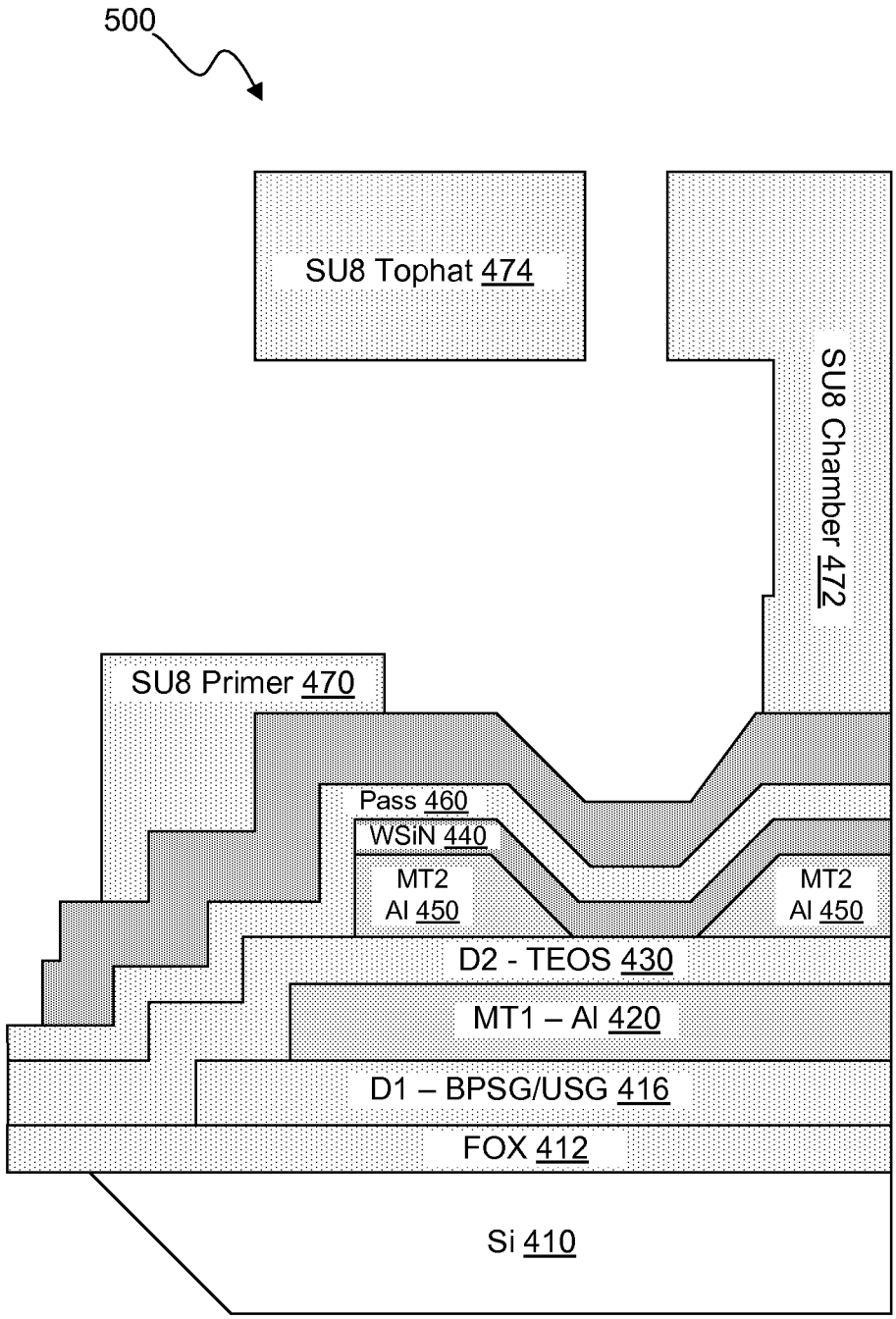
FIG. 5 is an illustrative diagram showing an ink jet printhead substrate including an ink chamber with a metal layer between the substrate and a resistive layer in accordance with an example.

Polymer layers 470, 472, and 474 can be deposited on the substrate. The polymer layers can include a polymer primer layer 470, a polymer chamber layer 472, and a polymer tophat layer 474. The bond pad layer can include photoresist, SU-8 molecules, polymer, epoxy, or combination. As illustrated in FIG. 5, a thermal inkjet chamber 500 can be formed in a polymer layer or plurality of polymer layers used in a thermal ink jet printhead. The polymer layers can be formed to create fluid flow channels and/or a trough in the thermal inkjet chamber with a thermal resistor. FIG. 5 provides an example illustration of the layers of FIG. 4 applied to form a thermal resistor and a thermal inkjet chamber.

Figure 6:
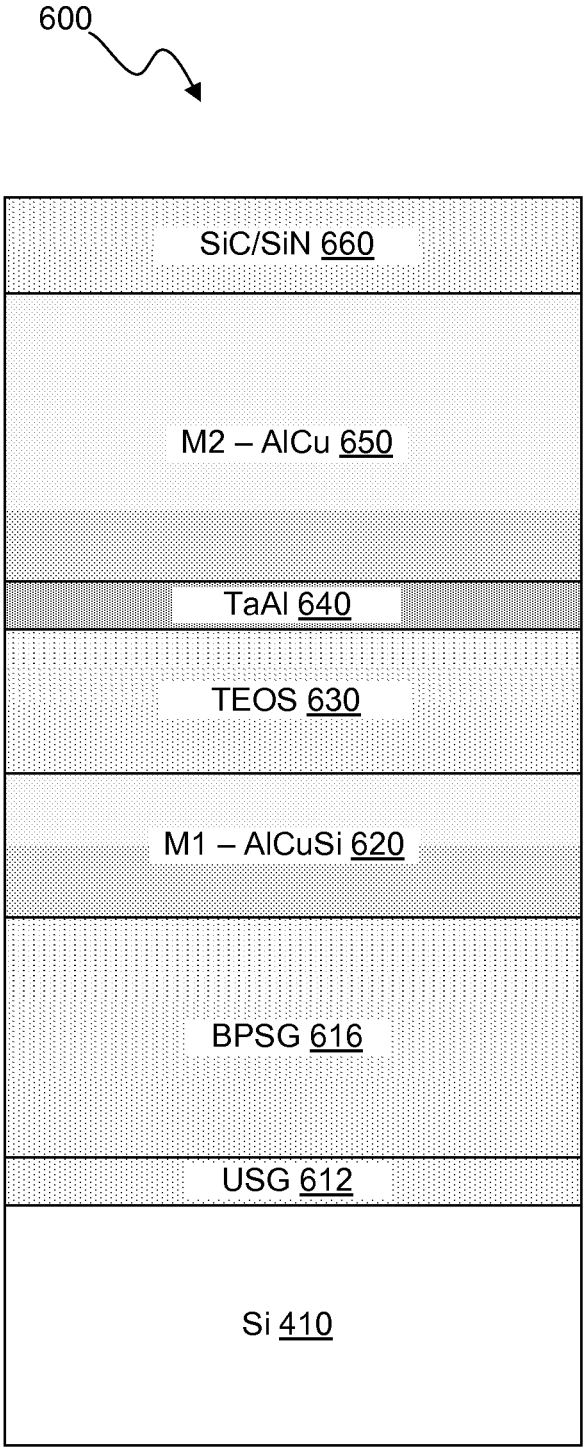
FIG. 6 is an illustrative diagram showing an ink jet printhead substrate with a metal layer between the substrate and a resistive layer along with other example layers in accordance with an example.

FIG. 6 illustrates another example of a thermal inkjet printhead 600, which can eliminate a gold bond pad layer along with adhesion layers used adhere the gold to other layers. A first dielectric layer 612 can be formed on a silicon (Si) 410 substrate. The first dielectric layer can be an undoped silicate glass (USG) layer. The USG layer can provide a silicate glass without dopants, such as boron and phosphate, which can leech into a silicon substrate and change the electrical characteristics of the silicon substrate. A second dielectric layer 616 can be formed on the substrate. The second dielectric layer can be a boro-phospho-silicate glass (BPSG) layer. The BPSG layer can be thicker than the USG layer. The BPSG layer and/or the USG layer can provide thermal and/or electrical insulation or isolation between first metal layer 620 and the silicon substrate. The BPSG layer may have better thermal and/or electrical insulation properties than a USG layer.

Figure 7:
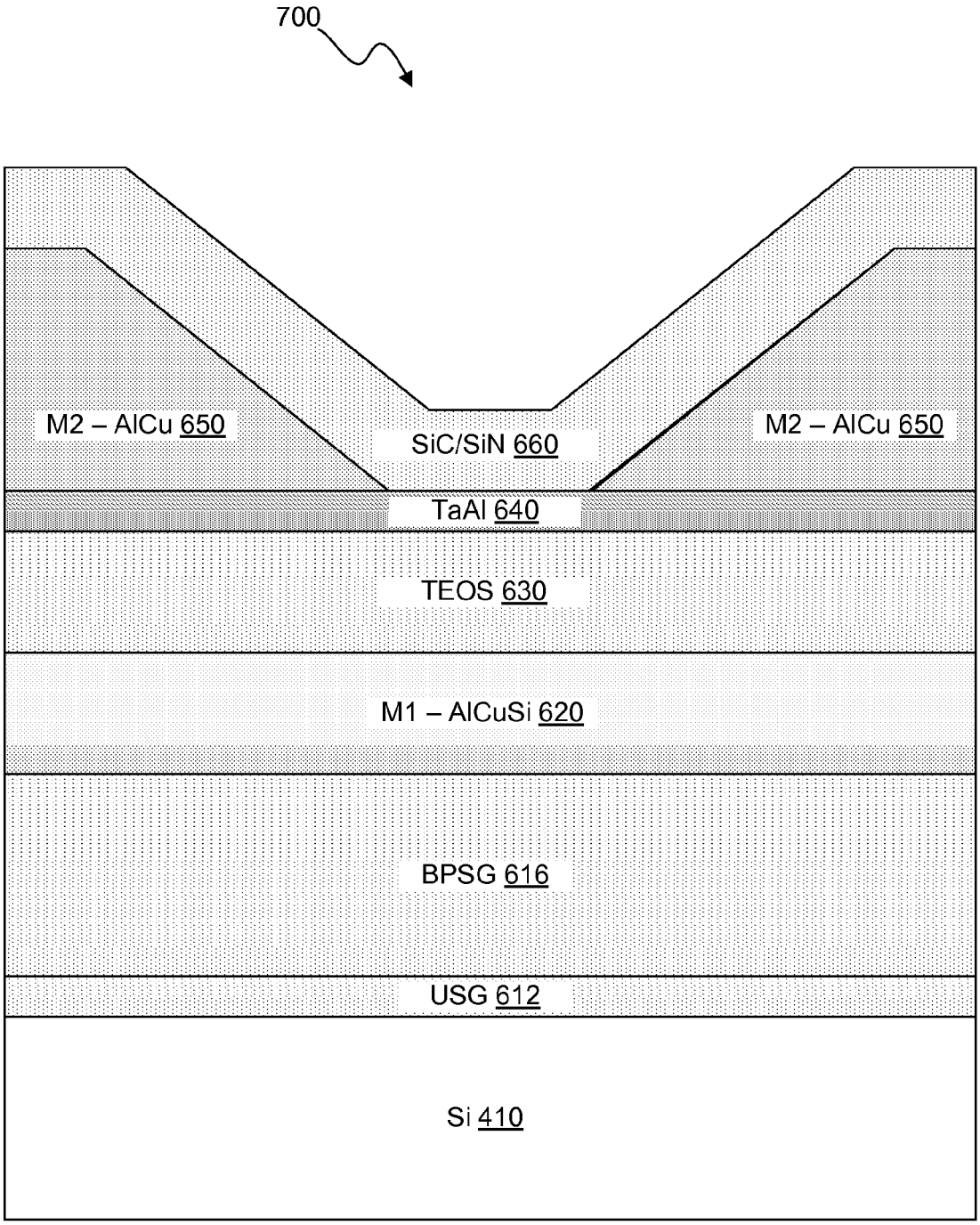
FIG. 7 is an illustrative diagram showing an ink jet printhead substrate with a first metal layer between the substrate and a resistive layer, and second metal layer adjacent to the resistive layer in accordance with an example.

A first metal layer 620 can be deposited on the substrate and can have a thickness to form a power and/or ground bus. The first metal layer may include AlCuSi. AlCuSi can be used to prevent or help reduce junction spiking. For example, the first metal layer can be between 0.4 μm and 2.0 μm thick, and can have a sheet resistance of approximately 100 mΩ/square. In an example, the first metal layer may cover at least 50% of an area or footprint of the printhead circuit, or the first metal layer may cover at least 50% of an area or a footprint under the thermal resistors of the thermal inkjet printhead 700, as illustrated by FIG. 7. A first metal layer can have a thickness to form a power bus or power/ground plane below the resistive layer.

Figure 8:
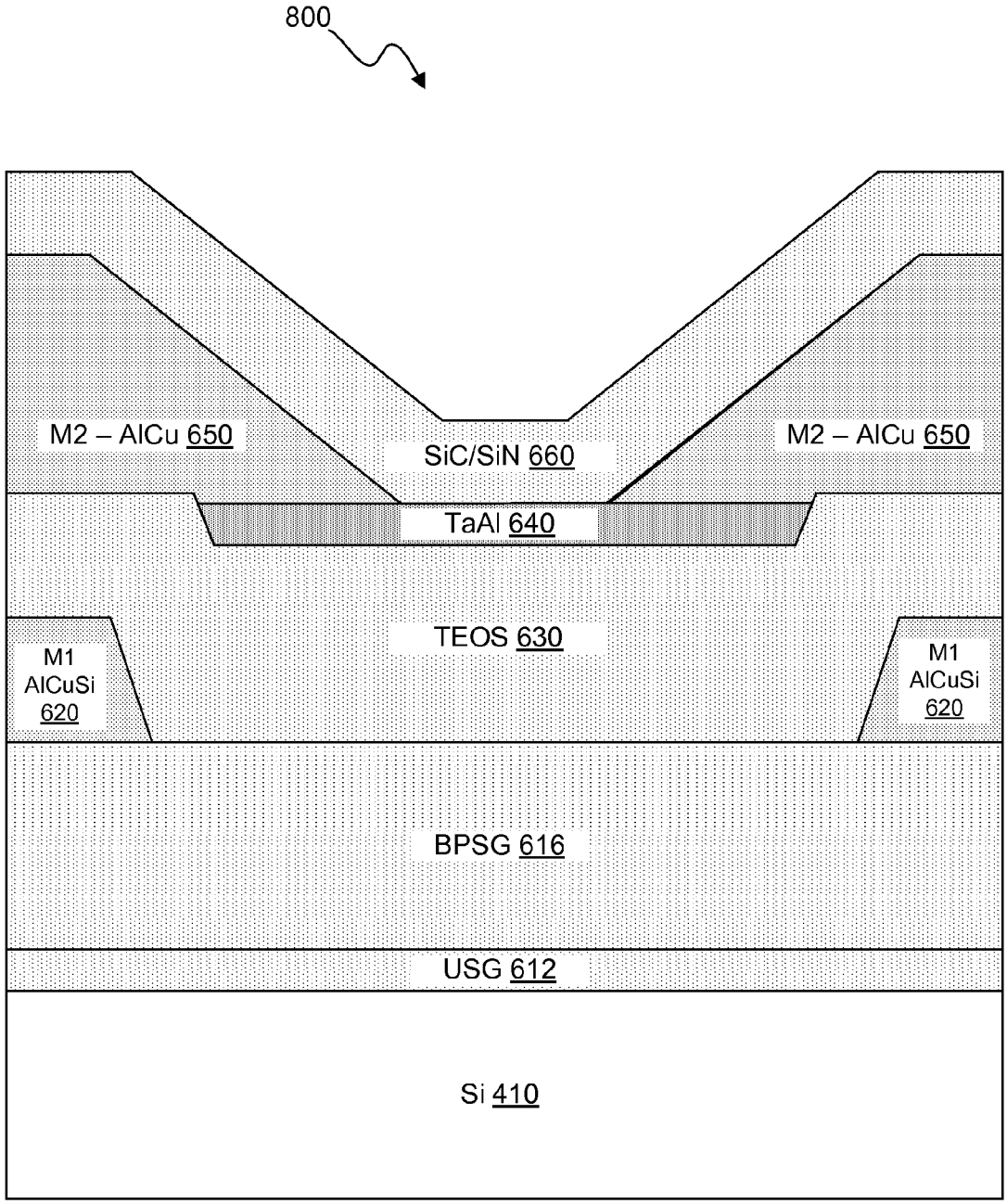
FIG. 8 is an illustrative diagram showing an illustrative diagram showing an ink jet printhead substrate with a metal layer between the substrate and a resistive layer, and with the metal layer removed below a thermal resistor in accordance with an example.

FIG. 7 provides an example illustration of the layers of FIG. 6 applied to form a thermal resistor and an ink chamber trench where a first metal layer is formed below the thermal resistor. FIG. 8 provides an example illustration of the layers of FIG. 6 applied to form a thermal resistor and an ink chamber trench where a first metal layer is removed from surrounding area below the thermal resistor, thus a first metal layer is not formed directly below the thermal resistor.

Returning to FIG. 6, a dielectric layer 630 can provide electrical insulation to prevent shorting between the thermal resistor in a resistive layer 640 and the first metal layer 620. The dielectric layer can have thickness to form a control gate. The dielectric layer thickness can be between 0.4 μm and 0.6 μm, which can be a comparatively thin dielectric layer. When the dielectric layer thickness is thin, the dielectric layer thickness may not provide adequate thermal and/or electrical insulation between a thermal resistor in the resistive layer and the first metal layer. As a result, the first metal layer can be removed under the thermal resistor so heat generated from the resistor in a resistive layer 640 may not dissipate or transfer to the thermally conductive first metal layer.

Removing the first metal layer (or M1) 620 under the thermal resistor formed in the resistive layer 640 and a surrounding buffer region in the thermal inkjet printhead 800, as illustrated in FIG. 8, can reduce the energy used to heat the ink and other fluids in the thermal inkjet chamber and reduce the heat transfer from the resistors in the resistive layer to the first metal layer. Removing the first metal layer under the thermal resistor can reduce unintended parasitic resistance between the resistive layer and metal layer and/or shorting between the resistive layer and metal layer. When the dielectric layer thickness is determined by control gate properties and/or when the dielectric layer is used for a control gate, the first metal layer may not have an area or a footprint under the thermal resistors of the printhead.

In FIG. 6, a resistive layer 640 can be deposited on the substrate. The resistive layer can have a sheet resistance between 20 Ω/square and 1000 Ω/square. The thermal resistor used in a thermal ink jet printhead can be formed in the resistive layer.

A second metal layer 650 can be deposited on resistive layer of the substrate and can have a thickness to form a power bus. The first metal layer and/or second metal layer can include Al, AlCu, AlCuSi, or combination. The second metal layer can include aluminum (Al) with copper (Cu). The second metal layer can be between 0.4 μm and 2.0 μm thick, and have a sheet resistance of less than 80 mΩ/square. The first metal layer and/or second metal layer can provide power and/or ground routing to and from bond pads. The second metal layer can provide a conductive path and contact to the thermal resistors formed in the resistive layer. In an example, the first metal layer and/or second metal layer may cover at least 50% of an area or footprint of the bond pads of the printhead. In another example, the second metal layer may cover at least 50% of an area or a footprint of the printhead circuit. Selectively etching the second metal layer can create a trench or trough for a thermal ink chamber, as illustrated in FIGS. 7-8.

A passivation layer 660 can be deposited on the substrate. The passivation layer can include SiC, SiN, or combination. The passivation layer can provide a protective coating and/or electrical insulation on the printhead, die, or wafer to protect the underlying circuits and layers from oxidation, corrosion, and other environmental conditions. The passivation layer can improve barrier adhesion. A polymer layer can be deposited on the substrate to form a thermal inkjet chamber (not shown).

Figure 9:
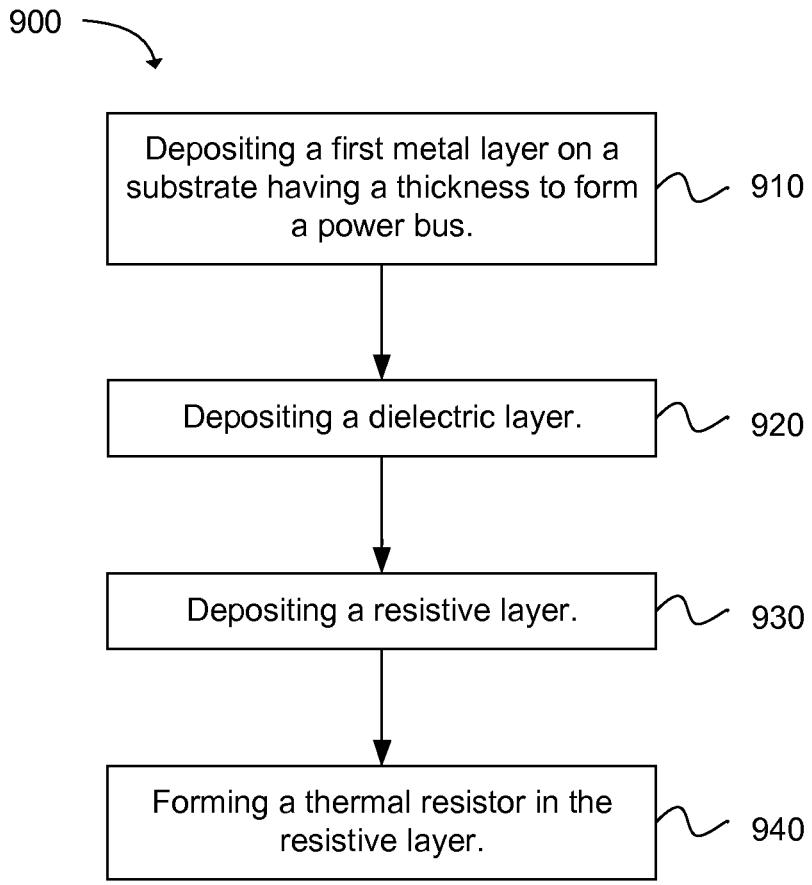
FIG. 9 is a flowchart illustrating a method for fabricating a thermal ink jet printhead in accordance with an example.

Another example provides a method 900 for fabricating a thermal ink jet printhead, as shown in the flow chart in FIG. 9. The method includes the operation of depositing a first metal layer on a substrate having a thickness to form a power bus, as in block 910. The operation of depositing a dielectric layer follows, as in block 920. The next operation of the method may be depositing a resistive layer, as in block 930. The method further includes forming a thermal resistor in the resistive layer, as in block 940. The second metal layer can be deposited adjacent to the resistive layer to connect the thermal resistor to control circuitry.

The method for fabricating a thermal ink jet printhead may further include removing the metal layer under the thermal resistor, depositing a polymer layer, forming a thermal inkjet chamber with the polymer layer, and/or forming control circuits with the substrate, first metal layer, second metal layer, dielectric layer, and other processing layers.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts described. Accordingly, it is not intended that the invention be limited, except as by the claims set forth below.

What is claimed is:

1. A thermal ink jet printhead, comprising:
a substrate;
a resistive layer;
a thermal resistor formed in the resistive layer;
a first metal layer between the substrate and the resistive layer having a thickness to form a power bus, the first metal layer having a hole under the thermal resistor; and
a dielectric layer between the first metal layer and the resistive layer.

2. The thermal ink jet printhead of claim 1, further comprising a thermal inkjet chamber formed in a polymer layer.

3. The thermal ink jet printhead of claim 1, wherein a thermal conductivity of the dielectric layer is between 0.05 W/cm° K and 0.2 W/cm° K.

4. The thermal ink jet printhead of claim 1, wherein a thermal diffusivity of the dielectric layer is between 0.004 $cm^2$/sec and 0.25 $cm^2$/sec.

5. The thermal ink jet printhead of claim 1, wherein a dielectric for the dielectric layer is selected from the group consisting of tetraethyl orthosilicate (TEOS or $Si(OC_2H_5)_4$), field oxide, silicon dioxide ($SiO_2$), undoped silicate glass (USG), phospho-silicate glass (PSG), boro-silicate glass (BSG), and boro-phospho-silicate glass (BPSG), $Al_2O_3$, $HfO_3$, SiC, SiN, and combination thereof.

6. The thermal ink jet printhead of claim 1, wherein the dielectric layer has a thickness between 0.4 μm and 2 μm to provide thermal insulation between the first metal layer and the resistive layer.

7. The thermal ink jet printhead of claim 1, wherein the dielectric layer has a thickness between 0.4 μm and 0.6 μm to form a control gate.

8. The thermal ink jet printhead of claim 1, wherein a sheet resistance of the resistive layer is between 20 Ω/square and 1000 Ω/square.

9. The thermal ink jet printhead of claim 1, wherein a resistive material in the resistive layer is selected from the group consisting of WSiN, TaSiN, TaAl, $Ta_2N$, and combination thereof.

10. The thermal ink jet printhead of claim 1, further comprising a second metal layer adjacent to the resistive layer to connect the thermal resistor to a control circuit.

11. The thermal ink jet printhead of claim 10, wherein the first metal layer or second metal layer includes AlCu or AlCuSi with a thickness between 0.4 μm and 2 μm.

12. The thermal ink jet printhead of claim 1, wherein a sheet resistance of the first metal layer or second metal layer is less than 45 mΩ/square.

13. The thermal ink jet printhead of claim 1, further comprising a bond pad metal layer including gold above the resistive layer wherein a sheet resistance of the bond pad metal layer is three times the value of sheet resistance of the first metal layer.

14. The thermal ink jet printhead of claim 1, wherein the metal in the first metal layer or second metal layer is selected from the group consisting of Al, AlCu, AlCuSi, and a combination thereof.

15. A method for fabricating a thermal ink jet printhead, the method comprising:
depositing a first metal layer on a substrate having a thickness to form a power bus;
depositing a dielectric layer over the first metal layer;
depositing a resistive layer over the dielectric layer;
forming a thermal resistor in the resistive layer; and
removing the metal layer under the thermal resistor.

16. The method of claim 15, further comprising:
depositing a polymer layer; and
forming a thermal inkjet chamber with the polymer layer.

17. The method of claim 15, further comprising depositing a second metal layer adjacent to the resistive layer to connect the thermal resistor to control circuitry.

18. A thermal ink jet printhead, comprising:
a substrate;
a resistive layer;
a thermal resistor formed in the resistive layer;
a metal layer between the substrate and the resistive layer having a thickness to form a power bus; the metal layer having a hole under the thermal resistor;
a dielectric layer between the metal layer and the resistive layer;
a passivation layer for protecting the substrate, the metal layer, the dielectric layer, and the resistive layer; and
a thermal inkjet chamber formed in a polymer layer.

19. The thermal ink jet printhead of claim 18, wherein a chamber material for the polymer layer is selected from the group consisting of photoresist, SU-8 molecules, polymer, epoxy, and combination thereof.

* * * * *